United States Patent [19]

Dobracki et al.

[11] Patent Number: 4,894,076

[45] Date of Patent: Jan. 16, 1990

[54] RECYCLE LIQUEFIER PROCESS

[75] Inventors: Thaddeus N. Dobracki, Emmaus; John D. Dubbs, Coopersburg; Roger M. McGuinness, Macungie; Janice C. Peterson, Allentown, all of Pa.

[73] Assignee: Air Products and Chemicals, Inc., Allentown, Pa.

[21] Appl. No.: 297,463

[22] Filed: Jan. 17, 1989

[51] Int. Cl.[4] ..... F25J 1/00

[52] U.S. Cl. ..... 62/9; 62/36; 62/39

[58] Field of Search ..... 62/9, 36, 38, 39

[56] References Cited

U.S. PATENT DOCUMENTS

| | | | |
|---|---|---|---|
| 3,285,028 | 11/1966 | Newton | 62/87 |
| 3,605,422 | 9/1971 | Pryor et al. | 62/13 |
| 3,616,652 | 11/1971 | Engel | 62/9 |
| 3,657,898 | 4/1972 | Ness et al. | 62/9 |
| 4,099,945 | 7/1978 | Skelaude | 62/30 |
| 4,169,361 | 10/1979 | Baldus | 62/402 |
| 4,189,930 | 2/1980 | Davydov et al. | 62/502 |
| 4,566,886 | 1/1986 | Fabian | 62/39 |
| 4,638,639 | 1/1987 | Marshall et al. | 62/9 |

*Primary Examiner*—Ronald C. Capossela

*Attorney, Agent, or Firm*—Willard Jones, II; James C. Simmons; William F. Marsh

[57] ABSTRACT

The present invention is a liquefaction process for atmospheric gases. In the process, one or more atmospheric gas streams (e.g., air, nitrogen, etc.) are compressed in a compression zone to provide both an intermediate stream and a high pressure stream. The high pressure stream is then cooled and at least a portion of it is expanded to provide refrigeration. The remaining high pressure stream is then further cooled and expanded whereby it is partially liquefied and separated into a vapor stream and a liquid atmospheric gas product stream. The intermediate pressure stream is cooled and at least a portion of it is expanded to provide refrigeration. The remaining intermediate pressure stream is further cooled and combined with the expanded portion of the high pressure stream and expanded to provide refrigeration. The discharge from this expansion, the vapor stream, and the discharge of the expansion of the portion of the intermediate pressure stream are warmed and recycled to the compression zone. The process of the present invention can include the use of companders and a dense-fluid expander.

9 Claims, 5 Drawing Sheets

RECYCLE LIQUEFIER PROCESS

TECHNICAL FIELD

The present invention relates to a process for the liquefaction of atmospheric gases, i.e., nitrogen. More specifically, the present invention relates to a higher pressure process for such liquefaction.

BACKGROUND OF THE INVENTION

Numerous processes are known in the art for the liquefaction of atmospheric gases; unfortunately, these processes tend to be energy intensive. In an effort to reduce the production costs associated with the manufacture of liquid atmospheric gases, a more efficient means of liquefaction is necessary. Past process designs have fallen into two major categories: high pressure and low pressure recycle systems.

High pressure recycle systems generally utilize nitrogen as the working fluid. These systems are characterized by operating pressures up to 3000 psia, which necessitates the use of reciprocating compression and expansion machinery. Although these systems achieve a high degree of thermodynamic efficiency, capital costs of machinery, exchangers and piping (due to high operating pressures) are greatly increased.

Low pressure recycle systems generally utilize nitrogen or air as the working fluid. These processes, because of the limited working pressures (approximately 700 psig), require lower capital costs in heat transfer and compression equipment. The machinery is often more reliable, since centrifugal compressors and expanders can be used; however, thermodynamic efficiency suffers at the lower operating pressures.

Specific examples of the preceding are as follow:

U.S. Pat. No. 4,638,639 discloses a process for liquefying a permanent gas stream which includes the steps of reducing the temperature of the permanent gas stream at elevated pressures to below its critical pressure and performing at least two working fluid cycles to provide at least part of the refrigeration necessary to reduce the temperature of the permanent gas to below its critical temperature. Each working fluid cycle comprises work-expanding the cooled working fluid in countercurrent heat exchange with the permanent gas stream and with the working fluid being cooled, refrigeration thereby being provided for the permanent gas stream. In at least one working fluid cycle, work-expanding working fluid is brought into countercurrent heat exchange relationship with the permanent gas at a temperature below the critical temperature of the permanent gas and in the or each such cycle on completion of the work expansion the working fluid is at a pressure of at least 10 atmospheres (147 psi).

U.S. Pat. No. 4,189,930 discloses a method of obtaining refrigeration at a cryogenic level comprising a gaseous fluid fed in the form of an incoming stream to sustain a refrigeration load. The incoming stream is stepwise cooled and expanded with liquefaction. The liquid fluid formed is used to sustain a refrigeration load, evaporating as a consequence, and the vapor constitutes a return stream which is adiabatically compressed so as to attain a temperature close to the temperature of the incoming stream before the liquefaction thereof.

U.S. Pat. No. 4,169,361 discloses a process wherein cold is generated by compressing a refrigerant and expanding the refrigerant isentropically in a nozzle. At least a part of the expanded refrigerant is passed in indirect heat exchange with the portion of the refrigerant prior to expansion. An expansion machine can be used to work-expand a portion of the compressed refrigerant with the expanded gas returned to the compressor. The balance of the compressed stream is expanded in the nozzle.

U.S. Pat. No. 4,099,945 discloses an improvement to a process for the fractionation of air. In the process, air is subjected to rectification in a high pressure column and a low pressure column, wherein in a liquefaction cycle, nitrogen is withdrawn in the gaseous phase from the top of the high pressure column and is liquefied by heating, compression, recooling and expansion and is recycled as liquid to the high pressure column. Also, wherein a gas, e.g., air, is withdrawn from the high pressure column, is preheated and is then expanded through a low-pressure expansion turbine. The improvement disclosed comprises cooling the gas expanded in the low pressure expansion turbine in indirect heat exchange with at least a portion of the nitrogen which is heated in the liquefaction cycle.

U.S. Pat. No. 3,605,422 discloses a process for the separation of a gas mixture under low pressure into components by a low temperature fractionating operation including an integrated refrigeration system which increases the liquid producing capabilities of the process for producing relatively large quantities of high purity products in the liquid phase without decreasing efficiency of the fractionating or sacrificing purity or yield of desired products.

U.S. Pat. No. 3,285,028 discloses refrigeration methods, more particularly of the type in which a normally gaseous fluid is expanded to produce refrigeration and the expanded fluid is passed in heat exchange with the higher pressure fluid so as to warm the former and cool the latter thereby to conserve refrigeration.

SUMMARY OF THE INVENTION

The present invention is a process for the liquefaction of atmospheric gases (i.e., a refrigeration process) which comprises compressing in a compression zone one or more atmospheric gas streams (e.g., air, nitrogen, etc.) to provide both an intermediate pressure stream and a high pressure stream.

The high pressure stream is then cooled and at least a portion of it is expanded in a first expansion step to provide refrigeration and produce a first expansion discharge. The remaining high pressure stream is then further cooled and expanded in a second expansion step whereby it is partially liquefied and separated into a vapor stream and a liquid product stream.

At least a portion of the intermediate pressure stream is expanded in a third expansion step to provide refrigeration and produce a third expansion discharge. The remaining intermediate pressure stream is cooled and combined with the first expansion discharge and expanded in a fourth expansion step to provide refrigeration and producing a fourth expansion discharge.

The fourth expansion discharge, the vapor stream from the second expansion step and the third expansion discharge are subsequently warmed and recycled to the compression zone.

As an option, the fourth expansion discharge and the vapor stream can be combined to produce a second combined stream, and which is then warmed and combined with the third expansion discharge to form a low pressure recycle stream. This low pressure recycle stream would then be warmed and returned to the compression zone.

In the process of the present invention, each of the first, second, third and fourth expansion steps can comprise expansion through a turboexpander and the compression in the compression zone can comprise multiple stages of centrifugal compression. Also, the work of compression for one or more of the stages of centrifugal compression can be provided by work of expansion from one or more of the turboexpanders.

The cooling of the high pressure and intermediate pressure streams can be accomplished by heat transfer with the vapor stream, the third expansion discharge, and the fourth expansion discharge, and wherein the heat transfer can be accomplished in an integrated heat exchange zone. Additionally, at least part of the cooling of the intermediate pressure stream can be provided by an external refrigeration source.

Finally, the process of the present invention is particularly suited to providing nitrogen product liquefaction in a cryogenic air separation process, wherein air is cooled and fed to a distillation zone comprising a high pressure and a low pressure column for fractionation thereby producing at least one gaseous nitrogen stream.

DETAILED DESCRIPTION OF THE INVENTION

The present invention in its broadest sense is a process for the liquefaction of atmospheric gases (i.e., a refrigeration process). In the process one or more atmospheric gas streams (e.g., air, nitrogen, etc.) are compressed in a compression zone to provide both an intermediate pressure stream and a high pressure stream.

This high pressure stream is then cooled and at least a portion of it is expanded to provide refrigeration, thereby producing a first expansion discharge. The remaining high pressure stream is then further cooled and expanded, preferably in a dense-fluid expander, whereby it is partially liquefied and separated into a vapor stream and a liquid atmospheric gas product stream.

At least a portion of the intermediate pressure stream is expanded to provide refrigeration, thereby producing a third expansion discharge. The remaining intermediate pressure stream is cooled and combined with the first expansion discharge and expanded to provide refrigeration, thereby producing a fourth expansion discharge.

The fourth expansion discharge, the vapor stream and the third expansion discharge are subsequently warmed and recycled to the compression zone.

The process of the present invention is particularly suited to providing nitrogen product liquefaction in a cryogenic air separation process, wherein air is cooled and fed to a distillation zone comprising a high pressure and a low pressure column for fractionation thereby producing at least one gaseous nitrogen stream.

To better understand the present invention, it is helpful to compare the process of the present invention first to a conventional low pressure recycle liquefier system and then to the process of U.S. Pat. No. 4,638,639.

Figure 1:
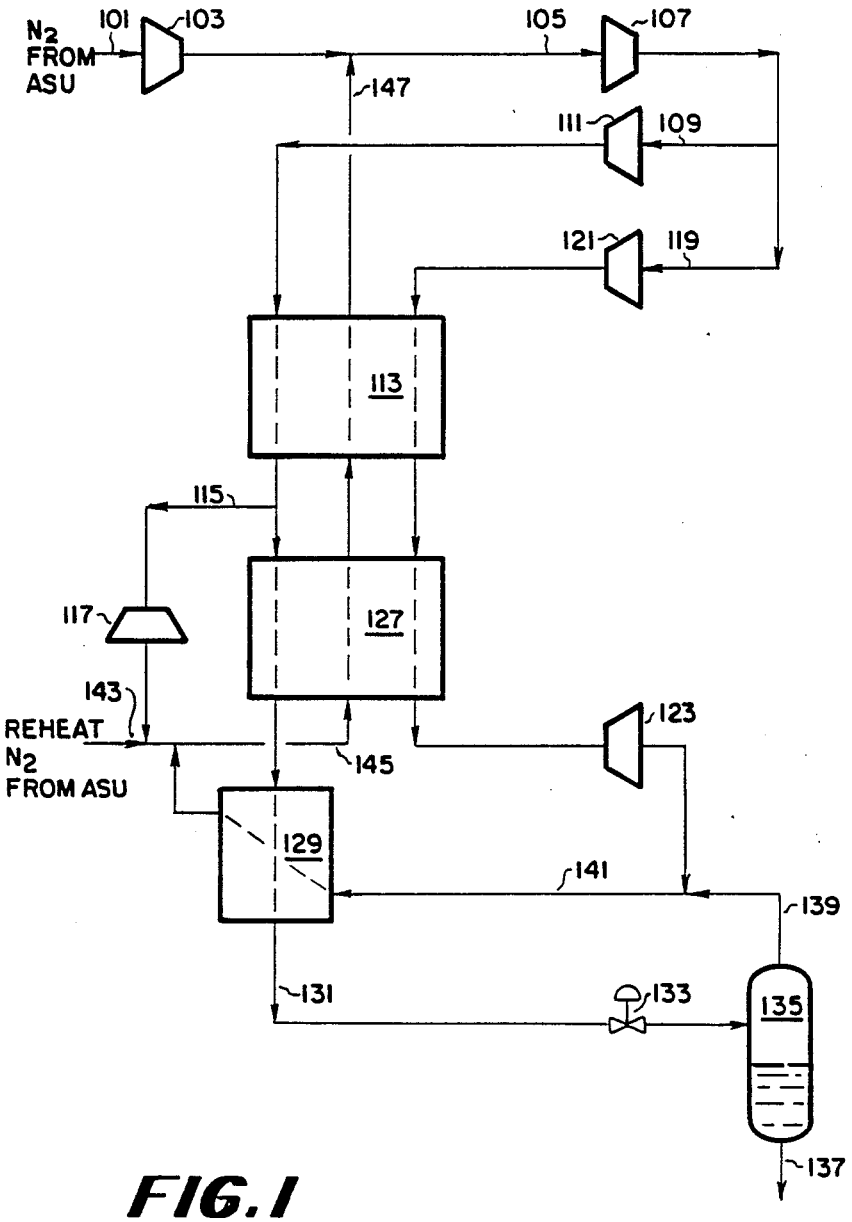
FIG. 1 PRIOR ART
FIG. 1 is a schematic diagram of a conventional atmospheric gas liquefier process.

A conventional low pressure recycle nitrogen liquefier process is illustrated in FIG. 1. With reference to FIG. 1, nitrogen from an air separation unit (ASU) [the air separation plant is not shown] is fed to the process via line 101 and compressed in compressor 103. Following this compression, the compressed nitrogen is combined with a low pressure recycle stream, in line 147, to form a combined low pressure feed and recycle stream, in line 105. This low pressure stream, in line 105, is compressed in compressor 107 and split into two substreams.

The first substream, in line 109, is further compressed in compressor 111 and cooled in heat exchanger 113. Following this initial cooling in heat exchanger 113, a side-stream is removed from the first substream via line 115. This side-stream, in line 115, is expanded in expander 117. The remaining portion of the first substream is then further cooled in heat exchangers 127 and 129. This further cooled, remaining first substream, now in line 131, is then flashed across J-T valve 133 and fed to phase separator 135 for separation into a liquid phase and a vapor phase. The liquid nitrogen product is removed from phase separator 135 via line 137.

The second substream, in line 119, is further compressed in compressor 121 and cooled in heat exchangers 113 and 127. This cooled, compressed second substream is then expanded in expander 123 following which is combined with the vapor overhead from phase separator 135, in line 139, to form a combined stream, in line 141. This combined stream, in line 141, is warmed in heat exchanger 129 and then further combined with reheat nitrogen from the air separation unit, in line 143, and the expanded stream 115 to form the low pressure recycle stream, in line 145. This low pressure recycle stream, in line 145, is warmed in heat exchangers 127 and 113 and then combined with nitrogen feed, in line 101, at the entrance to compressor 107.

Figure 2:
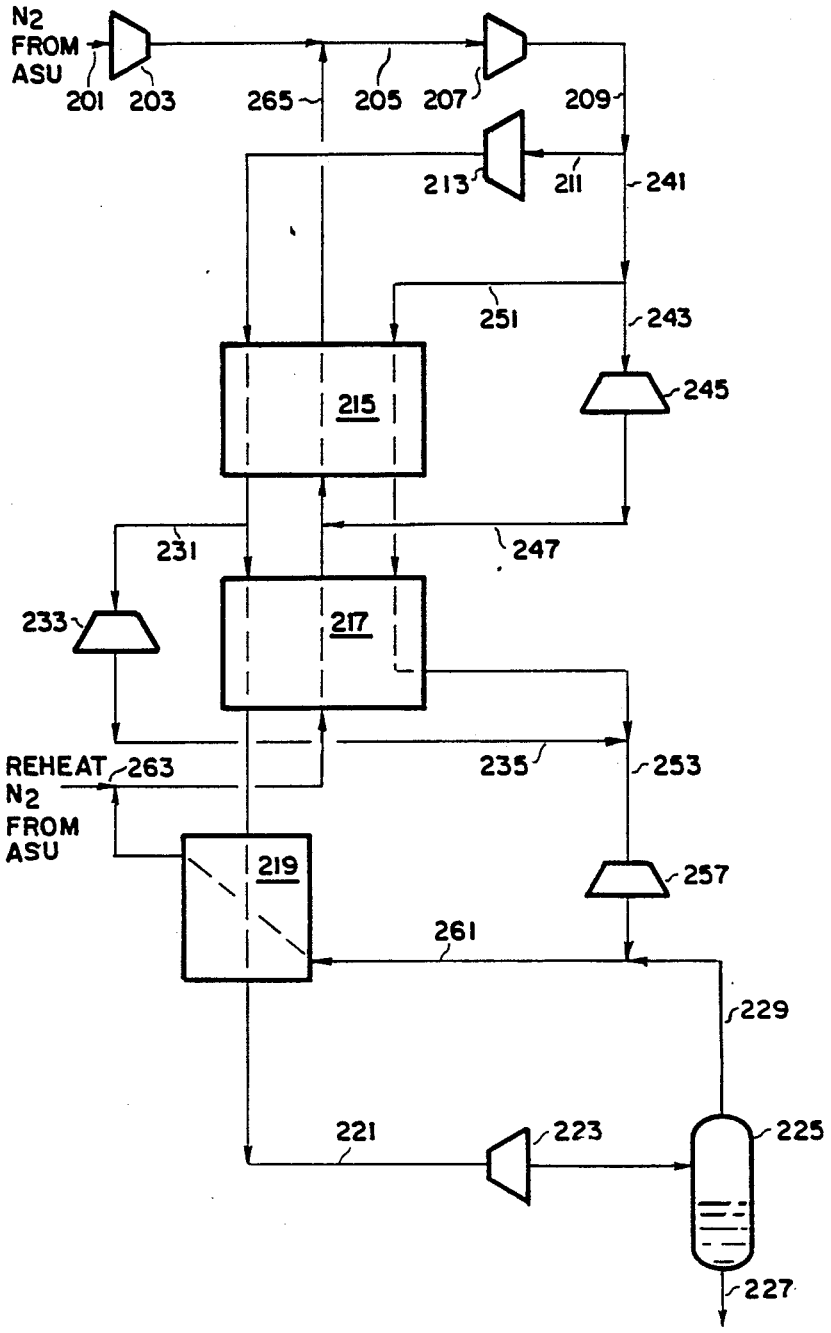
FIG. 2 is a simplified schematic diagram of the liquefier process of the present invention.

The present invention in a simple embodiment is illustrated in FIG. 2. With reference to FIG. 2, a nitrogen feed stream from an air separation unit (ASU not shown) is fed to the process via line 201 and compressed in compressor 203. Following this compression, the compressed nitrogen is combined with a low pressure recycle stream, in line 265, to form a combined low pressure feed and recycle stream, in line 205. This low pressure stream, in line 205, is compressed in compressor 207 and split into two substreams.

The first substream, in line 211, is further compressed in compressor 213 to a pressure of about 1200 psig thus producing the high pressure stream and is cooled in heat exchanger 215. Following this initial cooling in heat exchanger 215 a side-stream is removed from the high pressure stream via line 231. This side-stream, in line 231, is expanded to about 490 psia in expander 233. The remaining portion of the high pressure stream is then further cooled in heat exchangers 217 and 219. This further cooled, remaining high pressure stream, now in line 221, is then expanded to about 93.5 psia in expander 223 whereby the stream is partially liquefied and fed to phase separator 225 for separation into a liquid nitrogen product stream and a vapor overhead. The liquid nitrogen product is removed from phase separator 225 via line 227.

The second substream, in line 241, at an intermediate pressure of about 490 psia, is split into two portions. The first portion, in line 243, is expanded in expander 245 to provide refrigeration. The second portion, in line 251, is cooled in heat exchangers 215 and 217 and combined with the discharge from expander 233, in line 235, to form a combined stream, in line 253. This combined stream, in line 253, is then expanded to about 90 psia in expander 257 and combined with the vapor overhead from phase separator 225, in line 229, to form a second combined stream, in line 261. This second combined stream, in line 261, is warmed in heat exchanger 219 and then further combined with reheat nitrogen from the air separation unit, in line 263, warmed in heat exchanger 217 and further combined with the discharge from expander 245, in line 247, to form the low pressure recycle stream, in line 265. This low pressure recycle stream, in line 265, is warmed in heat exchanger 215 and then combined with nitrogen feed, in line 201, at the entrance to compressor 207.

Figure 3:
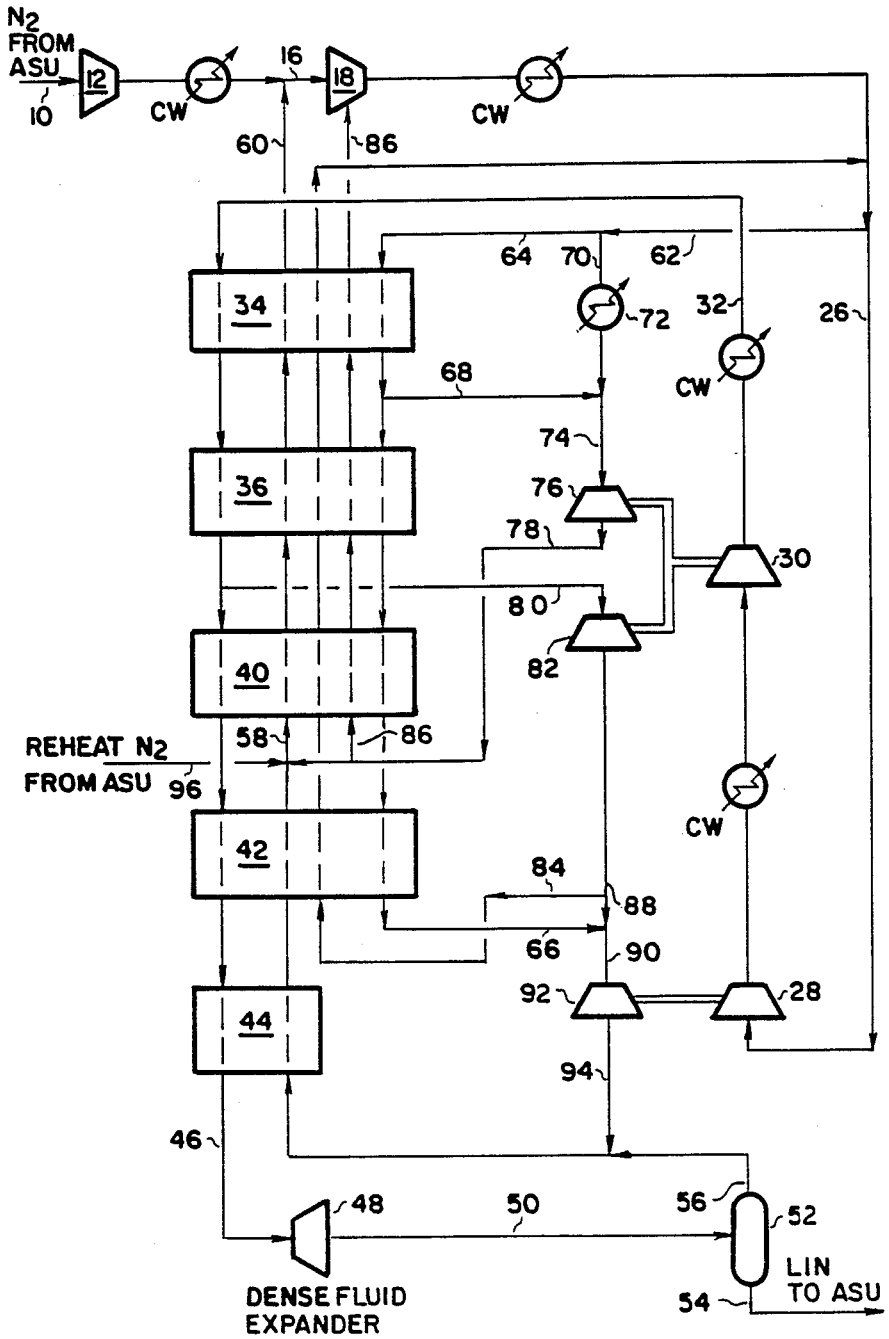
FIG. 3 is a schematic diagram of an specific embodiment of the liquefier process of the present invention.

Another complex embodiment of the process of the present invention is illustrated in FIG. 3; likewise in this embodiment, nitrogen is the atmospheric gas. With reference to FIG. 3, nitrogen from an air separation unit (the air separation unit is not shown) is fed to the process via line 10, compressed in compressor 12 and combined with the low pressure recycle stream, in line 60, to form a combined recycle and feed stream in line 16. This combined recycle and feed stream is then compressed in compressor 18 and split into two substreams.

The first substream of the compressed, combined recycle and feed stream, in line 26, is further compressed in compressors 28 and 30 forming high pressure stream 32. This high pressure stream is cooled in heat exchangers 34, 36, 40, 42 and 44. This cooled high pressure stream, now in line 46, is then expanded across expander 48 wherein it is partially liquefied. This partially liquefied stream is then fed via line 50 to phase separator 52 for separation into a liquid nitrogen product stream, which is removed via line 54, and a vapor overhead stream, which is removed via line 56.

The second substream of the compressed, combined recycle and feed stream, in line 62, is split into two portions. The first portion, in line 64, is cooled in heat exchangers 34, 36, 40 and 42 resulting in a cooled first portion in line 66. The second portion, in line 70, is cooled in refrigerant cooler 72 (e.g. fluorocarbon refrigerant), combined with a side-stream of the first portion, which is withdrawn from the first portion, in line 64, via line 68 between heat exchangers 36 and 38, to form a feed stream, in line 74, for expander 76.

A side-stream is removed via line 80 from the high pressure stream, in line 32, between heat exchangers 36 and 40. This side-stream is then expanded in expander 82; the discharge of which, in line 88, is combined with the cooled first portion in line 66 to form a feed stream, in line 90, for expander 92.

The discharge from expander 92, in line 94, is then combined with the vapor overhead from phase separator 52, in line 56, to form a combined stream, in line 57, which is then warmed in heat exchangers 44 and 42. Following this warming, this combined stream, in line 57, is further combined with the discharge from expander 76, in line 78, and reheat nitrogen from the air separation unit, in line 96, to form the low pressure recycle stream, in line 58. This low pressure recycle stream is then warmed in heat exchangers 40, 36 and 34 and then is combined via line 80 with the compressed nitrogen feed in line 10 to form the combined recycle stream in line 16 which is fed to compressor 18.

To make the process more energy efficient, expanders 76 and 82 and compressor 30, and expander 92 and compressor 28 can be tied together in a compander figuration. Other tying arrangements are equally possible.

Several options have also been illustrated in FIG. 3; among these are: (1) the addition of a refrigeration unit 72 which enables refrigeration to be provided at a relatively high level (shift in refrigeration to the warm end) and allows the expanders to be unloaded; (2) increasing the pressure of the warm expander 76 discharge, in line 78, and recycling such discharge via line 86 through heat exchangers 40, 36 and 34 to an interstage of compressor 18 [when using this option; discharge stream 78 would not be combined with streams 57 and 96](3) recycling all or part of the intermediate expander 82 discharge, in line 88, via line 84 to the suction of compressor 28; and (4) addition of dense-fluid expander 48 on the high pressure stream.

Figure 4:
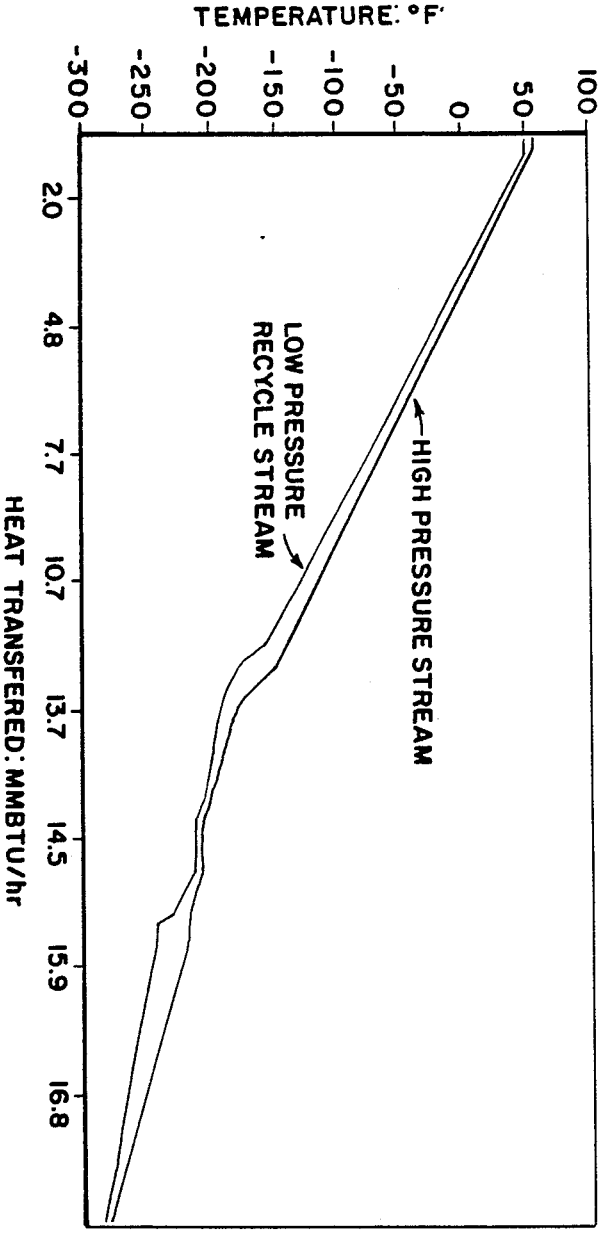
FIG. 4 is a plot of the heat transferred versus temperature for the high pressure stream and the warming stream for the conventional liquefier process, thus illustrating $\Delta T$ of the two streams.

All these changes made to the conventional low pressure recycle system address improvements in mechanical and thermodynamic efficiencies. For example, when analyzing the energy losses associated with the traditional low pressure recycle system depicted in FIG. 1, inefficiencies in heat transfer can be seen in the large temperature differences between the high pressure stream, line 109, and the low pressure recycle stream, line 145; these $\Delta T$'s are shown in FIG. 4. The shape of the two curves is the result of a pinch in the condensing section of the exchangers (i.e., at 700 psig, the condensation curve still relatively flat, causing a pinch in the warm exchanger).

Figure 5:
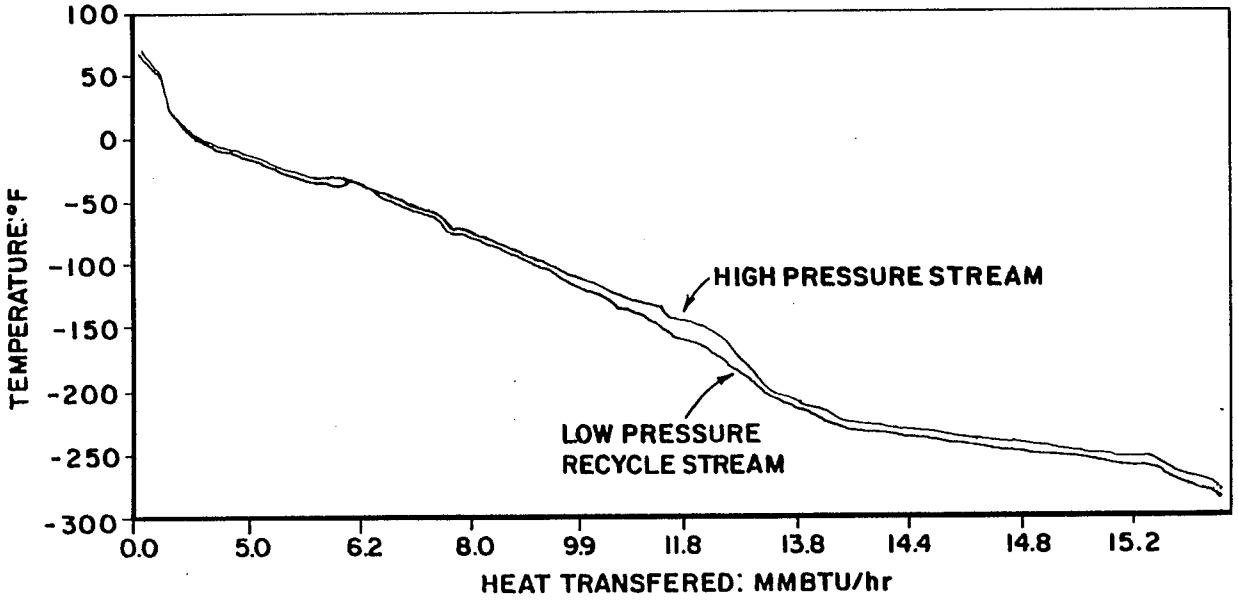
FIG. 5 is a plot of the heat transferred versus temperature for the high pressure stream and the warming stream for the liquefier process of the present invention, thus illustrating $\Delta T$ of the two streams.

Reduction of these energy losses has been accomplished in two ways in the present invention as depicted in FIG. 2. First, by increasing the high pressure stream, line 211, pressure, the condensing section of the cooling curve becomes much straighter. Therefore, large temperature differences are not needed into one section to overcome a pinch which occurs in a different section. Second, an intermediate compander is introduced to provide a better match to cooling curves. The $\Delta T$'s for the present invention process are shown in FIG. 5. Likewise, these temperature differences are between the high pressure stream, line 211, and the low pressure recycle stream, line 265.

Mechanical efficiencies can be improved in the companders by matching specific speeds. In this instance, it was found that the optimal mechanical arrangement was to allow two expanders to drive one compressor. In the recycle machine, for this example, the optimal arrangement was to return all recycle streams to the suction of the compressor. However, in some instances, an optimal arrangement may be to return part of the recycle to the interstage of this machine. Finally, utilization of a dense-fluid expander, rather than a JT valve, results in less flash losses that must be returned to the recycle compressor.

Although not wanting to be bound by any particular theory, the most plausible explanation of why the process of the present invention works is that improvements in the thermodynamic efficiency have been accomplished in two ways.

First, by increasing the condensing pressure of the working fluid, the losses that are generally experienced in heat transfer have been minimized. This is reflected in a reduction in the large temperature differences that are often seen between the JT stream and the returning low pressure stream. For example, comparisons of FIGS. #3 and #4 show that these maximum temperature differences have been reduced to approximately 17° F. from 30° F.

Second, the addition of a third compander has enabled a better match of cooling curves in the intermediate temperature range.

In addition, mechanical efficiency has also been improved. In the detailed embodiment, it was found that a better specific speed match between expanders and compressors occurred when two expanders were used to drive one compressor, rather than have a dedicated expander for every compressor. In some instances, mechanical efficiency can be improved by returning expander exhaust to an interstage of the recycle machine. This provides a power savings over the typical case, where expander exhaust is entirely recycled to the suction of the recycle machine.

Finally, to demonstrate the efficacy of the present invention, a energy efficiency comparison between the process of the present invention as depicted in FIG. 2, the process as depicted in FIG. 1 and the process of U.S. Pat. No. 4,638,639 was run. The results of this comparison is shown in Table I.

TABLE I

| | PROCESS DESIGNATION | | |
|---|---|---|---|
| | FIG. 1 | U.S. Pat. No. 4,638,639 | Present Invention |
| MINIMUM WORK: Isothermal Hp | 4805.4 | 4805.4 | 4805.4 |
| POWER REQUIREMENTS | | | |
| MAKE-UP/RECYCLE COMPRESSOR: Isothermal Hp | 6908.8 | 6369.1 | 6558.0 |
| REFRIGERATION UNIT: Isothermal Hp | N/A | 437.4 | N/A |
| TOTAL POWER REQUIREMENTS: Isothermal Hp | 6908.8 | 6806.5 | 6558.0 |
| PROCESS EFFICIENCY: % (Minimum work/Total power) | 69.6 | 70.6 | 73.3 |

As can be seen from Table I, the process of the present invention is considerably more energy efficient than the prior art processes. As a matter of fact, the process of the present invention is almost 4% more energy efficient than the best cited prior art.

The present invention has been described with reference to several specific embodiments thereof. These embodiments should not be viewed as a limitation on the scope of the present invention; such scope should be ascertained by the following claims.

We claim:

1. A process for the liquefaction of an atmospheric gas comprising:
   (a) compressing in a compression zone one or more atmospheric gas feed streams to produce an intermediate pressure stream and a high pressure stream;
   (b) cooling the high pressure stream;
   (c) removing at least a portion of the high pressure stream as a high pressure stream, side-stream and expanding the high pressure stream, side-stream in a first expansion step thereby providing refrigeration and producing a first expansion discharge;
   (d) further cooling and expanding the cooled high pressure stream in a second expansion step thereby producing a partially liquefied second expansion discharge;
   (e) phase separating the partially liquefied second expansion discharge into a vapor stream and a liquid product stream;
   (f) removing at least a portion of the intermediate pressure stream as an intermediate pressure stream, side-stream and expanding the intermediate pressure stream, side-stream in a third expansion step, thus providing refrigeration and producing a third expansion discharge;
   (g) cooling the intermediate pressure stream;
   (h) combining the cooled intermediate pressure stream of step (g) the first expansion discharge of step (c) to form a first combined stream, and expanding the first combined stream in a fourth expansion step, thus providing refrigeration and producing a fourth expansion discharge; and
   (i) warming and subsequently recycling to the compression zone the fourth expansion discharge of step (h), the vapor stream from step (e) and the third expansion discharge of step (f).

2. The process of claim 1, wherein each of the first, second, third and fourth expansion steps comprises expansion through a turboexpander.

3. The process of claim 1 wherein the compression in the compression zone comprises multiple stages of centrifugal compression.

4. The process of claim 1 wherein the cooling of the high pressure and intermediate pressure streams is accomplished by heat transfer with the vapor stream, the third expansion discharge, and the fourth expansion discharge, and wherein the heat transfer is accomplished in an integrated heat exchange zone.

5. The process of claim 1 wherein at least part of the cooling of the intermediate pressure stream is provided by an external refrigeration source.

6. The process of claim 1 wherein the atmospheric gas is nitrogen.

7. The process of claim 1 wherein each of the first, second, third and fourth expansion steps comprises expansion through a turboexpander; the compression in the compression zone comprises multiple stages of centrifugal compression; and work of compression for one or more of the stages of centrifugal compression is provided by work of expansion from one or more of the turboexpanders.

8. A process for the liquefaction of an atmospheric gas comprising:
   (a) compressing in a compression zone one or more atmospheric gas feed streams to produce an intermediate pressure stream and a high pressure stream;
   (b) cooling the high pressure stream;
   (c) removing at least a portion of the high pressure stream as a high pressure stream, side-stream and expanding the high pressure stream, side-stream in a first expansion step thereby providing refrigeration and producing a first expansion discharge;
   (d) further cooling and expanding the cooled high pressure stream in a second expansion step thereby producing a partially liquefied second expansion discharge;

(e) phase separating the partially liquefied second expansion discharge into a vapor stream and a liquid product stream;

(f) removing at least a portion of the intermediate pressure stream as an intermediate pressure stream, side-stream and expanding the intermediate pressure stream, side-stream in a third expansion step, thus providing refrigeration and producing a third expansion discharge;

(g) cooling the intermediate pressure stream;

(h) combining the cooled intermediate pressure stream of step (g) the first expansion discharge of step (c) to form a first combined stream, and expanding the first combined stream in a fourth expansion step, thus providing refrigeration and producing a fourth expansion discharge;

(i) combining the fourth expansion discharge of step (h) with the vapor stream from step (e) to produce a second combined stream, and warming the second combined stream;

(j) combining the second combined stream of step (i) with the third expansion discharge of step (f) to form a low pressure recycle stream; and (k) warming the low pressure recycle stream of step (j) and returning the warmed, low pressure stream to the compression zone.

9. In a process for the cryogenic separation of air, wherein air is cooled and fed to a distillation zone comprising a high pressure and a low pressure column for fractionation thereby producing at least one gaseous nitrogen stream, the improvement for liquefying the gaseous nitrogen streams comprises:

(a) compressing in a compression zone one or more gaseous nitrogen streams to produce an intermediate pressure stream and a high pressure stream;

(b) cooling the high pressure stream;

(c) removing at least a portion of the high pressure stream as a high pressure stream, side-stream and expanding the high pressure stream, side-stream in a first expansion step thereby providing refrigeration and producing a first expansion discharge;

(d) further cooling and expanding the cooled high pressure stream in a second expansion step thereby producing a partially liquefied second expansion discharge;

(e) phase separating the partially liquefied second expansion discharge into a vapor stream and a liquid nitrogen product stream;

(f) removing at least a portion of the intermediate pressure stream as an intermediate pressure stream, side-stream and expanding the intermediate pressure stream, side-stream in a third expansion step, thus providing refrigeration and producing a third expansion discharge;

(g) cooling the intermediate pressure stream;

(h) combining the cooled intermediate pressure stream of step (g) the first expansion discharge of step (c) to form a first combined stream, and expanding the first combined stream in a fourth expansion step, thus providing refrigeration and producing a fourth expansion discharge; and (i) warming and recycling to the compression zone the fourth expansion discharge of step (h), the vapor stream from step (e) and the third expansion discharge of step (f).

* * * * *